US005852430A

United States Patent [19]

Endo

[11] Patent Number: 5,852,430

[45] Date of Patent: Dec. 22, 1998

[54] COLOR LIQUID CRYSTAL DISPLAY DEVICE

[75] Inventor: Kenzo Endo, Hachioji, Japan

[73] Assignee: Casio Computer Co., Ltd., Tokyo, Japan

[21] Appl. No.: 629,508

[22] Filed: Apr. 9, 1996

[30] Foreign Application Priority Data

Apr. 20, 1995 [JP] Japan ..... 7-095280
Jun. 26, 1995 [JP] Japan ..... 7-180579

[51] Int. Cl.[6] ..... G09G 3/36

[52] U.S. Cl. ..... 345/101; 345/88

[58] Field of Search ..... 345/88, 101, 106, 345/148, 150

[56] References Cited

U.S. PATENT DOCUMENTS 4,923,285 5/1990 Ogino et al. ..... 345/101
5,471,229 11/1995 Okada et al. ..... 345/101

*Primary Examiner*—Raymond J. Bayerl
*Assistant Examiner*—Matthew Luu
*Attorney, Agent, or Firm*—Frishauf, Holtz, Goodman, Langer & Chick

[57] ABSTRACT

A temperature detection circuit and two RAMs are connected to a conversion circuit for converting image data into voltage designation signals and outputting the signals to a signal electrode driver. The temperature detection circuit detects the temperature of a liquid crystal display element as one of conditions which influence the behavior of liquid crystal molecules. One RAM is used to store a conversion table in which voltage designation signals for designating effective voltage to be applied to a liquid crystal layer are preset for image data for each predetermined temperature range of the liquid crystal display element. The other RAM is used to store input image data. In the conversion table, the number of different voltage designation signals in a high-temperature range is set to be smaller than that of different voltage designation signals in a normal temperature range. The conversion circuit reads out voltage designation signals in accordance with a detection signal from the temperature detection circuit and image data, and outputs the signals to the signal electrode driver. With this operation, effective voltages corresponding to the voltage designation signals are applied to the liquid crystal layer, and a color display with excellent perceptibility can always be obtained regardless of the temperature of the liquid crystal display element.

21 Claims, 9 Drawing Sheets

| IMAGE DATA | DETECTED TEMPERATURE < 40°C | DETECTED TEMPERATURE ≧ 40°C |
|---|---|---|
| WHITE | 0 | 0 |
| ≈ | ≈ | ≈ |
| RED | 5 | 7 |
| BLUE | 6 | 7 |
| GREEN | 7 | 7 |

FIG.5

| IMAGE DATA | DETECTED TEMPERATURE < 30°C | DETECTED TEMPERATURE < 40°C | DETECTED TEMPERATURE < 50°C | DETECTED TEMPERATURE ≧ 50°C |
|---|---|---|---|---|
| WHITE | 0 | 0 | 0 | 0 |
| ⋮ | ⋮ | ⋮ | ⋮ | ⋮ |
| RED | 5 | 4 | 3 | 7 |
| BLUE | 6 | 5 | 4 | 7 |
| GREEN | 7 | 6 | 5 | 7 |

FIG.7

| IMAGE DATA | DETECTED TEMPERATURE < 40°C | DETECTED TEMPERATURE ≧ 40°C |
|---|---|---|
| WHITE | 0 | 3 |
| ≈ | ≈ | ≈ |
| RED | 5 | 3 |
| BLUE | 6 | 4 |
| GREEN | 7 | 7 |

FIG.8

COLOR LIQUID CRYSTAL DISPLAY DEVICE

BACKGROUND OF THE INVENTION

1. Field of the Invention

The present invention relates to a color liquid crystal display device for displaying different colors in accordance with the applied voltages and, more specifically, to a color liquid crystal display device that can provide a clear display even at high device temperatures.

2. Description of the Related Art

Conventionally, a liquid crystal display device is known well as a display device for a TV set, a personal computer, an electronic table calculator, or the like. Recently, a color liquid crystal display device capable of displaying chromatic colors, e.g., a color display for a liquid crystal color TV set, a computer terminal, or the like has been generally used.

As a color liquid crystal display device, a transmission type device having a liquid crystal cell sandwiched between a pair of polarizing plates and a backlight (illumination light source) outside one of the polarizing plates is generally used. In this case, the liquid crystal cell is obtained by sealing a liquid crystal between a pair of transparent substrates which are arranged to oppose each other, while transparent electrodes are formed on the opposing surfaces of the transparent substrates. A color filter for selectively transmitting light having a specific wavelength is formed on one of the transparent substrates.

Output of light from the backlight is controlled by ON/OFF-controlling a driving voltage applied between the pair of transparent electrodes. Light from the backlight is selectively filtered by the color filter when the light is transmitted through the color filter in the liquid crystal display device, thereby coloring the light in a specific color. A color display operation is performed by using the transmitted light colored by the color filter.

Since a color filter generally has a low transmittance, a great loss of transmitted light occurs in a color liquid crystal display device using the conventional color filter, resulting in a dark display. is A reflection type liquid crystal display device which is generally used as the display portion of a portable device such as an electronic table calculator or a wristwatch has no special light source. In addition, if a color filter is arranged in this device, light is transmitted through the color filter twice before and after it is reflected, resulting in a loss of light. Consequently, the display becomes darker. It is, therefore, very difficult to provide a color display operation using the color filter.

In addition, high precision is required for a color filter in terms of dimensions, e.g., thickness, and assembly, similar to other optical elements such as polarizing plates. This will increase the cost of the liquid crystal display device.

Furthermore, in a color liquid crystal display device using color filters, since one pixel corresponding to one electrode displays only the color of one color filter provided for the electrode, one display dot must be constituted by a plurality of pixels having a plurality of color filters having different colors in order to display many colors. Many pixels are therefore required to display many colors. As a result, the structure of the color liquid crystal display device is complicated. Especially when a multicolor display operation is performed by using a dot matrix display type having many display dots, the structure of the device is further complicated.

As a color liquid crystal display device using no color filter, a color liquid crystal display device of a birefringence control scheme is known. In this device, an electric field is applied to the liquid crystal layer to change the aligned state or orientational order of the liquid crystal molecules, and a color image is displayed by using the resultant change in birefringence action.

In a liquid crystal display device of this type, even if the same voltage is applied to the liquid crystal, the birefringence action of the liquid crystal changes with a change in the temperature of the liquid crystal, resulting in a change in display color. Consequently, a display failure such as a color offset that a display color differs from a designated color occurs, resulting in a deterioration in display quality.

In order to solve this problem, for example, Japanese Patent Application No. 6-105047 (U.S. patent application Ser. No. 08/422,982) discloses a technique of compensating for (adjusting) the applied voltages to suppress variations in display color in accordance with the ambient temperature and the characteristics of a color liquid crystal display device.

The temperature range in which compensation for the applied voltages can be performed is about 0° C. to 40° C. at best. It is, however, difficult to perform compensation with respect to temperatures exceeding this range. As a result, the display quality and the perceptibility deteriorate.

SUMMARY OF THE INVENTION

It is an object of the present invention to provide a color liquid crystal display device having a simple structure which can increase light transmittance by coloring transmitted light without using any color filter, sufficiently increase the brightness of a display, display a plurality of colors with one pixel, and always provide a clear color display regardless of various liquid crystal driving conditions such as temperature.

In order to achieve the above object, according to the present invention, there is provided a color liquid crystal display device comprising a liquid crystal display element for controlling a birefringence action of a liquid crystal layer sandwiched between a pair of substrates by applying a voltage to the liquid crystal layer, thereby displaying a plurality of colors, image data supply means for supplying image data for defining colors to be displayed, and drive control means for selecting one of at least two groups including a first group constituted by n (a positive integer) different effective voltages preset for the image data, and a second group constituted by m (a positive integer different from n) different effective voltages preset for the image data, and applying the effective voltages in the selected group which are related to the image data to the liquid crystal layer.

According to the color liquid crystal display device having the above structure, an appropriate group of effective voltages is selected from a plurality of effective voltage groups constituted by the different numbers of effective voltages to be applied to the liquid crystal layer in accordance with a driving condition and the like which influence the behavior of the liquid crystal molecules, and effective voltages, in the selected group, which are set in correspondence with image data are applied to the liquid crystal layer. With this operation, when the liquid crystal driving condition is normal, the effective voltages for displaying the colors defined by the image data are applied to the liquid crystal layer without any change, thereby obtaining a desired multicolor display. If the liquid crystal driving condition or the like is abnormal, the number of display colors is forcibly changed to perform a color display operation while maintaining necessary perceptibility, even though a color display operation with the colors defined by the image data cannot be performed.

In the above color liquid crystal display device, the drive control means preferably comprises means for selecting a group of effective voltages to be applied in accordance with a condition which influences a behavior of liquid crystal molecules of the liquid crystal display element, selecting effective voltages corresponding to the image data from the selected group of effective voltages, and applying the effective voltages to the liquid crystal layer.

The drive control means may comprise detection means for detecting a change in the condition which influences the behavior of the liquid crystal molecules of the liquid crystal display element and outputting a correction signal, and control means for receiving the correction signal, selecting a group of effective voltages to be applied in accordance with the correction signal, selecting effective voltages corresponding to the image data from the selected group of effective voltages, and applying the effective voltages to the liquid crystal layer.

In addition, the drive control means may comprise detection means for detecting a change in the condition which influences the behavior of the liquid crystal molecules of the liquid crystal display element and outputting a correction signal, voltage generating means for generating n different signal voltages to be applied to one of groups of electrodes respectively formed on opposing surfaces of a pair of substrates of the liquid crystal display element, and means for selecting the group of effective voltages in accordance with the correction signal from the detection means, selecting signal voltages, from the n signal voltages, which can provide at least one effective voltage, in the selected group of effective voltages, which correspond to the image data, and applying the selected signal voltages to the electrodes.

Furthermore, the drive control means preferably comprises detection means for outputting a detection signal by detecting a temperature of the liquid crystal display element, and means for selecting a group of effective voltages to be applied in accordance with a correction signal from the detection means, selecting at least one effective voltage corresponding to the image data from the selected group, and applying the effective voltages to the liquid crystal layer. With this structure, a color display with excellent perceptibility can always be obtained regardless of the temperature of the liquid crystal display element.

The selecting means preferably comprises storage means for storing effective voltages to be applied to the liquid crystal layer in accordance with the image data for each of a plurality of temperature ranges of the liquid crystal display element, and voltage applying means for reading out effective voltages from the storage means on the basis of the image data and the detection signal, and applying the effective voltages to the liquid crystal layer.

The selecting means may comprise voltage generating means for generating pulse signal voltages to be applied to one of groups of electrodes formed on opposing surfaces of the substrates of the liquid crystal display element, storage means for storing voltage designation signals for designating effective voltages to be applied to the liquid crystal layer of the liquid crystal display element for each of a plurality of temperature ranges of the liquid crystal display element in correspondence with the image data, and voltage modulation applying means for reading out the voltage designation signals from the storage means in accordance with the image data and the detection signal, modulating the pulse voltages in accordance with the readout voltage designation signals, and applying the modulated voltages to the electrodes. In this case, as the voltage modulation applying means, a pulse width modulation type voltage modulation applying means for changing pulse widths of the pulse voltages in accordance with the voltage designation signals, or a pulse height modulation type voltage modulation applying means for changing pulse heights of the pulse voltages in accordance with the voltage designation signals can be suitably used. The storage means stores n voltage designation signals for designating n effective voltages in a range not exceeding a predetermined temperature, and one of two voltage designation signals for designating lowest and highest voltages of the n effective voltages in a range exceeding the predetermined temperature in correspondence with the image data. With this operation, a clear two-color display can be obtained even if the temperature rises abnormally.

The drive control means may comprise detection means for detecting a voltage of a power supply for generating a voltage to be applied to the liquid crystal display element, and means for selecting a group of effective voltages to be applied in accordance with a detection signal from the detection means, selecting effective voltages corresponding to the image data from the selected group of effective voltages, and applying the effective voltages to the liquid crystal layer. With this structure, a color display with excellent perceptibility can be obtained regardless of variations in power supply voltage.

The liquid crystal display element preferably comprises a liquid crystal cell having a liquid crystal layer set in an aligned state to twist liquid crystal molecules between a pair of substrates, a pair of polarizing plates arranged to sandwich the liquid crystal cell, a retardation plate arranged between one of the polarizing plates and the liquid crystal cell, and a reflecting plate for reflecting light emerging from the polarizing plate on a rear surface side opposite to a display surface to cause the light to be incident on the polarizing plate on the rear surface side. In this case, a twist angle of liquid crystal molecules of the liquid crystal cell is an angle within a range of 230° to 270°, a value of a product $\Delta n \cdot d$ of a refractive index anisotropy $\Delta n$ of a liquid crystal and a liquid crystal layer thickness d is a value within a range of 1,300 nm to 1,500 nm, and a value of a retardation of the retardation plate is a value within a range of 1,450 nm to 1,750 nm.

The above object of the present invention can also be achieved by a color liquid crystal display device comprising a liquid crystal display element for controlling a birefringence action of a liquid crystal layer by applying voltages to the liquid crystal layer sandwiched between a pair of substrates, thereby displaying a color image constituted by a plurality of display colors, image data supply means for supplying image data for designating a color, of n colors, which is to be displayed, and drive control means for driving the liquid crystal display element such that at least two types of images expressed by different combinations of colors, one type of image being expressed by a combination of n colors, and the other type of image being expressed by a combination of m colors smaller in number than n colors, are switched in accordance with a condition which influences a behavior of liquid crystal molecules.

The drive control means of this color liquid crystal display device may comprise detection means for detecting a temperature of the liquid crystal display element and outputting a detection signal or detection means for detecting a voltage of a power supply for generating a voltage to be applied to the liquid crystal display element and outputting a detection signal, and means for switching the combinations of the colors of images in accordance with the detection signal from the detection means.

It is another object of the present invention to provide a method of driving a color liquid crystal display device for performing a color display operation by using the birefringence action of light without using any color filter, which can always provide a clear color display regardless of a liquid crystal driving condition such as temperature.

In order to achieve the above object, there is provided a method of driving a color liquid crystal display device, comprising a step of controlling a birefringence action of a liquid crystal layer sandwiched between a pair of substrates by applying voltages corresponding to image data to the liquid crystal layer, thereby displaying a plurality of colors, a step of supplying the image data for defining colors to be displayed, the step of defining a first group of n (a positive integer) effective voltages preset for the image data, a step of defining a group, other than the first group, which is constituted by m (a positive integer different from n) different effective voltages preset for the image data, and a voltage application step of selecting one of the first group and the group other than the first group, and applying effective voltages, of the effective voltages of the selected group, which are preset for the image data to the liquid crystal layer.

In the above driving method, the voltage application step preferably comprises a sub-step of outputting a correction signal in accordance with a condition which influences a behavior of liquid crystal molecules of the liquid crystal display element, and a sub-step of selecting a group of effective voltages to be applied to the liquid crystal in accordance with the correction signal, and applying effective voltages, of the selected group of effective voltages, which correspond to the image data to the liquid crystal layer.

In the above driving method, each of the steps of defining the groups of effective voltages preferably includes a sub-step of storing effective voltages to be applied to the liquid crystal layer for each temperature range of the liquid crystal display element in accordance with the image data, and the voltage application step preferably comprises a sub-step of detecting a temperature of the liquid crystal display element and outputting a detection signal, a sub-step of reading out effective voltages from the storage means in accordance with the image data and the detection signal, and a sub-step of applying the readout effective voltages to the liquid crystal layer.

In addition, in the above driving method, each of the steps of defining the groups of effective voltages preferably includes a sub-step of storing voltage designation signals for designating effective voltages to be applied to the liquid crystal layer for each of a plurality of temperature ranges of the liquid crystal display element in correspondence with the image data, and the voltage application step preferably comprises a sub-step of generating pulse signal voltages to be applied to one of groups of electrodes formed on opposing surfaces of the substrates of the liquid crystal display element, a sub-step of detecting a temperature of the liquid crystal display element and outputting a detection signal, a sub-step of reading out the voltage designation signals from the storage means in accordance with the detection signal and the image data, and a sub-step of modulating the pulse signal voltages in accordance with the readout voltage designation signals and applying the modulated voltages to the liquid crystal layer. In this case, the sub-step of storing the voltage designation signals is preferably a sub-step of storing, in the storage means, n voltage designation signals for designating n effective voltages in a range not exceeding a pre-determined temperature of the liquid crystal display element, and one of two voltage designation signals for designating lowest and highest voltages of the n effective voltages in a range exceeding the pre-determined temperature in correspondence with the image data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 5 is a view showing a conversion table stored in a conversion circuit in FIG. 4;

FIG. 7 is a view showing a modification of the conversion table in FIG. 5;

FIG. 8 is a view showing another modification of the conversion table in FIG. 5.

DETAILED DESCRIPTION OF THE PREFERRED EMBODIMENTS

A simple matrix color liquid crystal display device according to an embodiment of the present invention will be described below with reference to the accompanying drawings.

The structure of a liquid crystal display element used in this embodiment will be described first with reference to FIG. 1 and FIGS. 2A to 2D.

Figure 1:
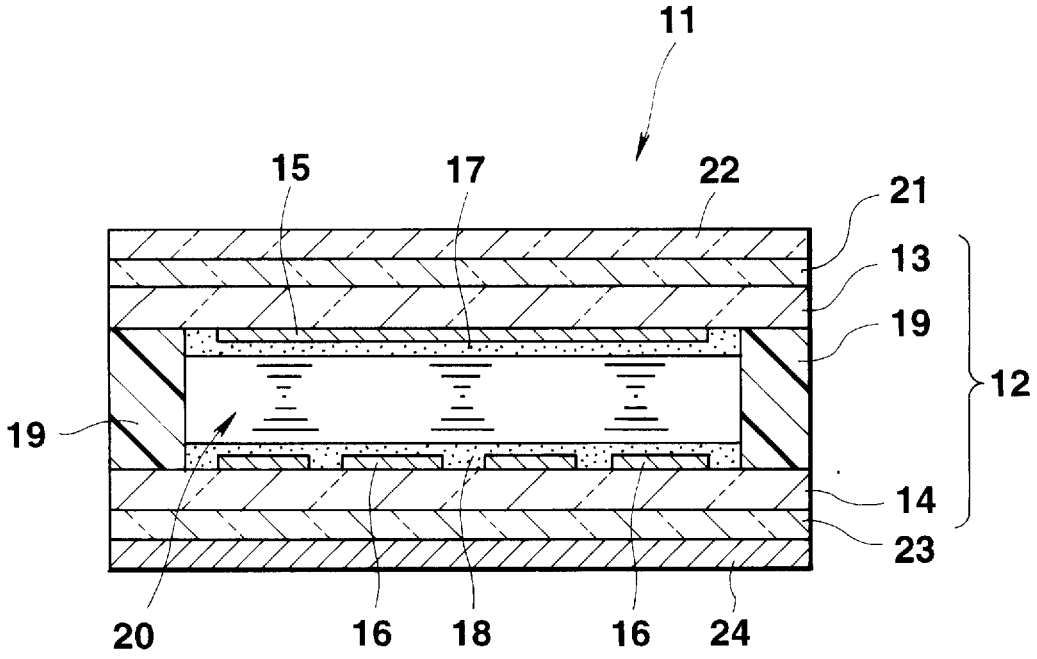
FIG. 1 is a sectional view showing a liquid crystal display element in a color liquid crystal display device according to an embodiment of the present invention.

FIG. 1 is a sectional view showing the structure of a liquid crystal display element 11 of this embodiment.

Referring to FIG. 1, upper and lower glass substrates 13 and 14 of a liquid crystal cell 12 oppose each other through a narrow space (several $\mu$m) in which a liquid crystal layer 20 is sealed. A plurality of scanning elements 15 and a plurality of signal electrodes 16, each consisting of a transparent conductive material such as ITO (indium/tin oxide), are formed on the opposing surfaces of the upper and lower glass substrates 13 and 14 to cross each other.

Aligning films 17 and 18 are respectively formed on the inner surfaces of the glass substrates 13 and 14 to cover the surfaces of the scanning and signal electrodes 15 and 16 formed on these inner surfaces. The aligning films 17 and 18 serve to regulate the aligning directions of liquid crystal molecules. The surfaces of the aligning films 17 and 18 have undergone an aligning treatment such as a rubbing method of rubbing the surfaces with a piece of cloth to align the long axis directions of adjacent liquid crystal molecules along the respective aligning directions.

A frame-like seal member 19 is disposed on a peripheral portion between the upper and lower glass substrates 13 and 14 to keep the predetermined space between the glass substrates 13 and 14 and to seal the liquid crystal between the upper and lower glass substrates located inside the seal member 19.

A product $\Delta n \cdot d$ of an optical anisotropy $\Delta n$ and a thickness d of a liquid crystal layer 20 is set to be 1,300 nm to 1,500 nm. The liquid crystal molecules are twisted/aligned at a twist angle of 230° to 270° in accordance with the aligning treatment applied to the aligning films 17 and 18.

A retardation plate 21 elliptically polarizes linearly polarized light transmitted through an upper polarizing plate 22. The optic axis (phase advance or phase delay axis) of the retardation plate 21 is tilted from the transmission axis of the upper polarizing plate 22, which is adjacent to the retardation plate 21, by a predetermined angle. The retardation of the retardation plate 21 is set to be about 1,450 nm to 1,650 nm.

The upper polarizing plate 22 and a lower polarizing plate 23 serve to cut off (absorb) polarized light components in the absorption axis direction and transmit polarized light components in a direction perpendicular to the absorption axis direction.

A reflecting plate 24 is disposed on the lower surface of the lower polarizing plate 23 to reflect light incident on the upper polarizing plate 22 and transmitted through the liquid crystal cell 12 and the lower polarizing plate 23 toward the liquid crystal cell 12 side. In this embodiment, the reflecting surface of the reflecting plate 24 is made of silver to reduce the wavelength dependence of the diffusion transmittance, thereby increasing the display brightness components of all wavelengths. Even if, therefore, a transparent touch panel is stacked on the display surface, a necessary display brightness can be ensured.

FIGS. 2A to 2D are plan views of the respective constituent elements, which show a combination of the aligning directions of the liquid crystal cell 12, the optic axis of the retardation plate 21, and the transmission axes of the upper and lower polarizing plates 22 and 23.

Figure 2A:
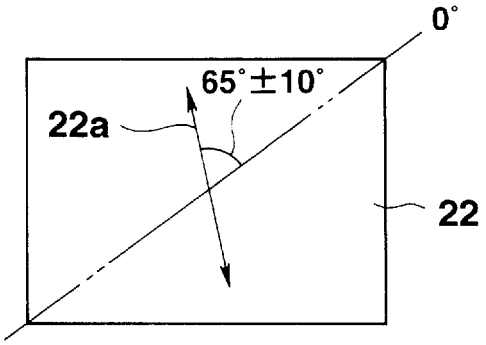
FIGS. 2A to 2D are plan views respectively showing the direction of the transmission axis of one polarizing plate, the direction of the phase delay axis of a retardation plate, the aligning treatment directions of a liquid crystal cell, and the direction of the transmission axis of the other polarizing plate in the liquid crystal display element in FIG. 1.
Figure 2B:
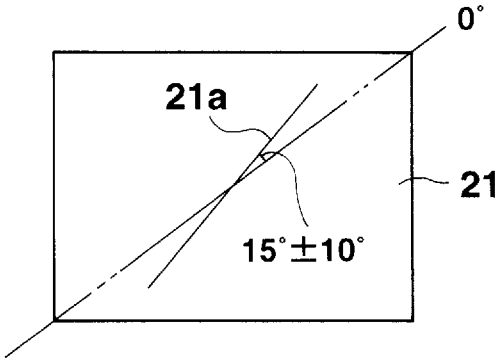
Figure 2C:
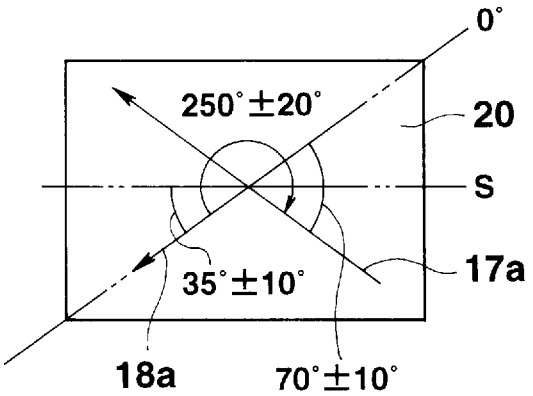
Figure 2D:
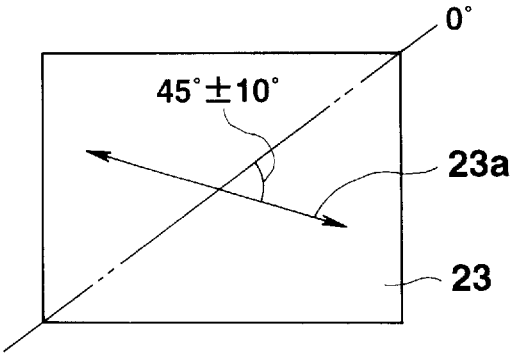

Double-arrow straight lines 22*a* and 23*a* in FIGS. 2A and 2D respectively indicate the transmission axes of the upper and lower polarizing plates 22 and 23. A straight line 21*a* in FIG. 2B indicates the optic axis of the retardation plate 21.

Single-arrow straight lines 17*a* and 18*a* in FIG. 2C respectively indicate the aligning treatment directions of the aligning films 17 and 18.

For the sake of descriptive convenience, an alternate long and short dashed line S is drawn in each of FIGS. 2A to 2D to indicate a reference line extending along the lateral direction of the display surface.

As shown in FIG. 2C, the aligning treatment directions 17*a* and 18*a* are inclined with respect to the reference line S in opposite directions at a predetermined angle of 35°±10°. With this setting, the liquid crystal molecules are twisted/aligned from the lower glass substrate 14 to the upper glass substrate 13 at an angle of 250°±20°.

The optic axis 21*a* of the retardation plate 21 in FIG. 2B is, for example, a phase delay axis, which obliquely crosses the aligning treatment direction 18*a* of the aligning film 18 at 15°±10°, with the aligning treatment direction 18*a* being set at 0°.

As shown in FIG. 2A, the transmission axis 22*a* of the upper polarizing plate 22 is inclined by 65°±10° with respect to the direction of 0°.

As shown in FIG. 2D, the double-arrow straight line 23*a* of the lower polarizing plate 23 is inclined by 45°±10° with respect to the-direction of 0°.

Figure 3:
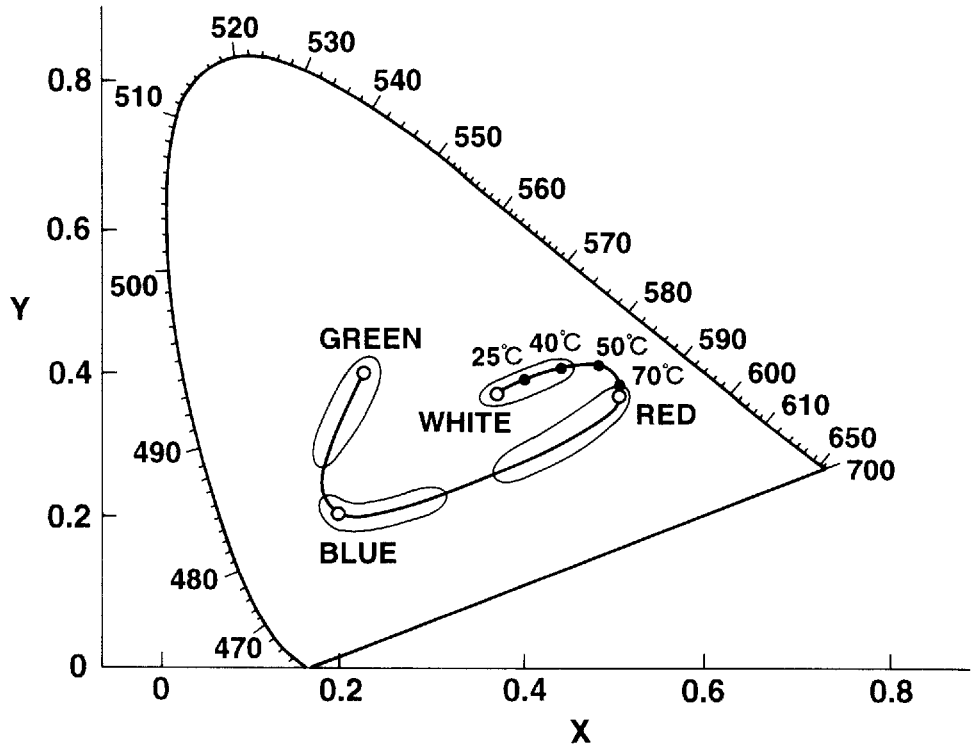
FIG. 3 is a CIE chromaticity diagram of the liquid crystal display element in FIG. 1.

FIG. 3 shows the CIE chromaticity diagram of the liquid crystal display element having the above structure. As shown in FIG. 3, as the effective voltage applied to the liquid crystal layer is raised, the display color of this liquid crystal display element changes as follows: white→red→blue→green.

The aligned state of the liquid crystal molecules changes with a change in temperature. For this reason, even if the same effective voltage is applied to the liquid crystal display element 11, the display color changes in accordance with temperature. For example, as indicated by the CIE chromaticity diagram of FIG. 3, even if an effective voltage for displaying "white" is applied to the liquid crystal display element 11 at about 25° C., the display color gradually approaches "red" as the temperature rises. At 50° C. or more, the display color almost becomes "red".

For this reason, in the liquid crystal display element having the above structure, when the temperature rises while images and data are displayed in "red" and other colors while the background is displayed in "white", the background portion and the display portion for the data and the images cannot be distinguished from each other.

In this embodiment, therefore, the effective voltage is changed in eight levels at normal temperature (below 40° C.) to perform color display in eight colors. When the temperature becomes high (40° C. or more), a display operation is performed while the effective voltages at all the intermediate levels are replaced with the effective voltage at the highest level. With this operation, a clear two-color display can be obtained instead of a multicolor display.

Figure 4:
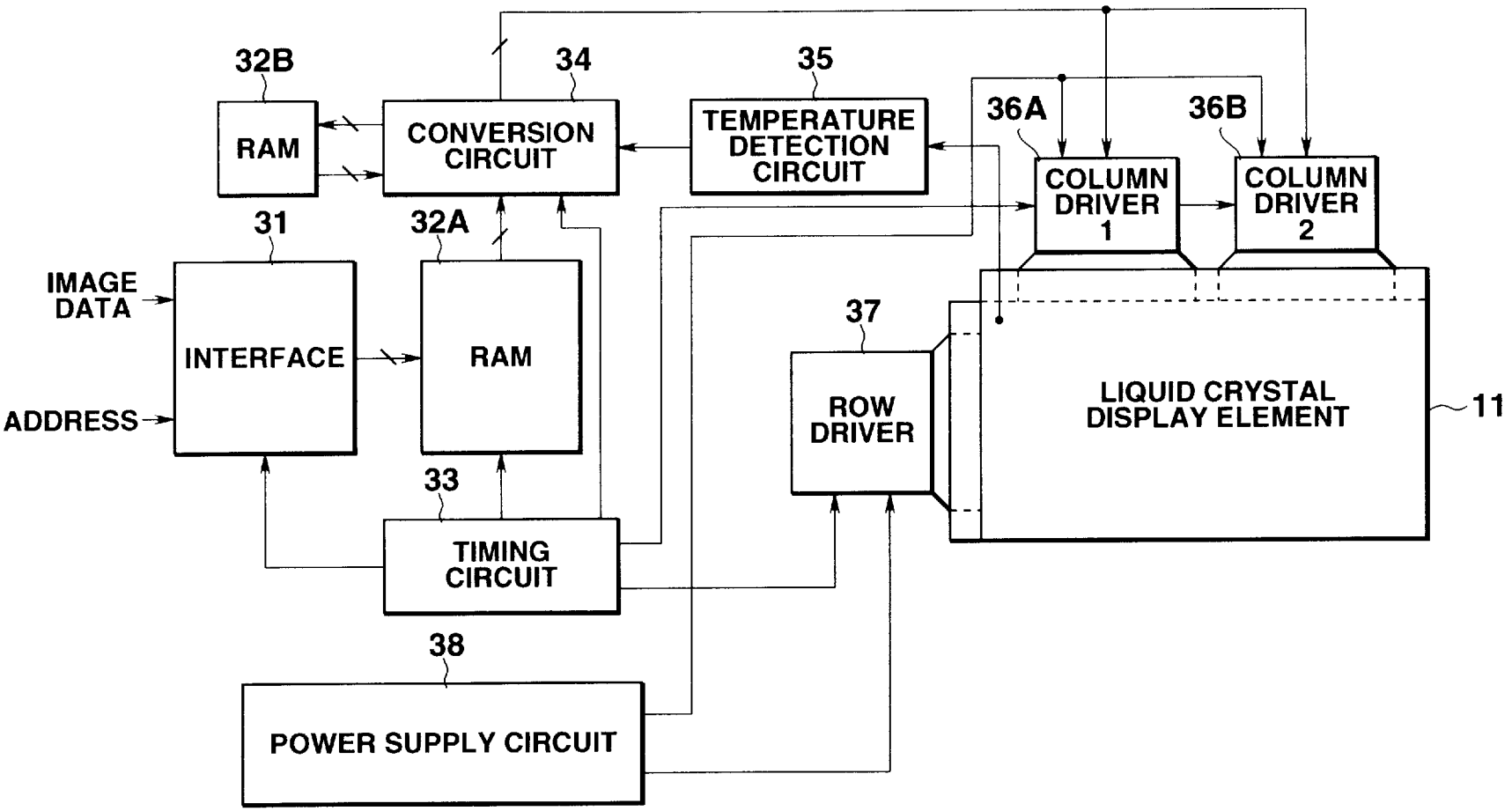
FIG. 4 is a block diagram showing the liquid crystal display element and its drive control circuit.

The arrangement of a driving circuit for the liquid crystal display element 11 having the structure will be described next with reference to FIG. 4.

The driving circuit in this embodiment includes an interface 31, RAMs 32A and 32B, a timing circuit 33, a conversion circuit 34, a temperature detection circuit 35, column drivers 36A and 36B for driving the signal electrodes, a row driver 37 for driving the scanning electrodes, and a power supply circuit 38.

Image data for defining display images, i.e., display colors, and addresses indicating display positions are supplied from an external circuit to the interface 31. The interface 31 sequentially stores the image data in the RAM 32A at positions designated by the supplied addresses.

Image data is read out from the RAM 32A in accordance with a timing control signal supplied from the timing circuit 33, and is output to the conversion circuit 34.

The temperature detection circuit 35 is constituted by a temperature sensor, an A/D converter, and the like, and detects the temperature of the liquid crystal display element 11, particularly, the temperature of the liquid crystal layer 20.

The RAM 32B stores the conversion table shown in FIG. 5. The conversion circuit 34 reads out a voltage designation signal (pulse width designation signal) from the RAM 32B in accordance with image data supplied from the RAM 32A and a temperature detection signal sent from the temperature detection circuit 35, and outputs the signal to the column drivers 36A and 36B.

In this embodiment, an eight-color display operation can be performed by applying effective voltages at a maximum of eight levels to the liquid crystal layer 20. For display operations at normal temperatures (below 40° C.), image data for defining eight colors and eight voltage designation signals (level codes 0 to 7) for designating effective voltages for displaying the colors defined by the image data are stored in the RAM 32B in correspondence with each other. For display operations at high temperatures (40° C. or more), image data and voltage designation signals are stored in the RAM 32B in correspondence with each other in such a manner that all the voltage designation signals (level codes 1 to 6) corresponding to the image data for defining colors displayed by the effective voltages at the intermediate levels become a voltage designation signal (level code 7) for designating the effective voltage at the highest level. These data and signals are stored as a conversion table.

When image data read out from the RAM 32A defines "red", and the detected temperature from the temperature detection circuit 35 is a normal temperature, the conversion circuit 34 outputs a voltage designation signal of level code "5". When the detected temperature is a high temperature (40° C. or more), the conversion circuit 34 outputs a voltage designation signal of level code "7". When the image data defines "blue", and the detected temperature is a normal temperature, the conversion circuit 34 outputs a voltage designation signal of level code "6". When the detected temperature is a high temperature, the conversion circuit 34 outputs a voltage designation signal of level code "7". When the image data defines "green", the conversion circuit 34 outputs a voltage designation signal of level code "7" regardless of the detected temperature.

The column drivers 36A and 36B are connected to the signal electrodes 16 of the liquid crystal display element 11 by the TAB method, the COG method, or the like. The column drivers 36A and 36B apply signal voltages indicated by waveforms (B) and (D) in FIG. 6 to the signal electrodes 16 in accordance with a timing control signal from the timing circuit 33 and a voltage designation signal supplied from the conversion circuit 34.

More specifically, each signal voltage consists of a pulse voltage, and the column drivers 36A and 36B adjust each effective voltage applied to the liquid crystal layer 20 by changing a pulse width W.

Letting T be the selection period for each column, i.e., each scanning electrode, and G be the value of the level code, the pulse width W is given by $W=T\cdot G/7$. As indicated by the waveform (B) in FIG. 6, therefore, W=0 for level code 0, W=T for level code 7, and W=T/7 to 6T/7 for level codes 1 to 6, as indicated by the waveform (D).

The row driver 37 is connected to the scanning electrodes 15 of the liquid crystal display element 11 by the TAB method, the COG method, or the like. The row driver 37 applies a scanning voltage indicated by a waveform (A) in accordance with a timing control signal.

The power supply circuit 38 generates voltages V0 to V3 used by the column drivers 36A and 36B to generate signal voltages. The power supply circuit 38 also generates voltages V0 and V4 to V6 used by the row driver 37 to generate scanning voltages.

The operation of the color liquid crystal display device having the above structure will be described next.

Image data supplied from an external CPU or the like and written in the RAM 32A via the interface 31 are sequentially read out to the conversion circuit 34 in accordance with a timing control signal from the timing circuit 33.

The temperature detection circuit 35 detects the temperature of the liquid crystal display element 11 and outputs a detection signal representing the detected temperature to the conversion circuit 34.

In response to a timing control signal, the conversion circuit 34 reads out a voltage designation signal from the conversion table stored in the RAM 32B in accordance with the temperature detection signal and the image data from the RAM 32A, and outputs the voltage designation signal to the column drivers 36A and 36B.

When the detected temperature is 30° C., since it is below 40° C., the conversion circuit 34 refers to the conversion table for below 40° C., in FIG. 5 to read out a voltage designation signal corresponding to the image data read out from the RAM 32A. That is, the conversion circuit 34 converts the image data into a voltage designation signal. For example, image data for defining "white" is converted into a voltage designation signal of level code "0"; image data for defining "red", a voltage designation signal of level code "5"; image data defining "blue", a voltage designation signal of level code "6"; and image data for defining "green", a voltage designation signal of level code "7". The conversion circuit 34 then outputs such a voltage designation signal.

The column drivers 36A and 36B modulate the signal voltage in accordance with the supplied voltage designation signal and apply the modulated signal voltage to the signal electrodes 16. For example, upon reception of a voltage designation signal of level code "0", each driver outputs a signal voltage of W=0, which is indicated by the waveform (B) in FIG. 6, to the signal electrodes 16. Upon reception of a voltage designation signal of level code "7", each driver outputs a signal voltage of W=T, which is indicated by the waveform (B) in FIG. 6, to the signal electrodes 16. Upon reception of any one of voltage designation signals of level codes "1" to "6", each driver outputs a signal voltage of W=T/7 to 6T/7 for an intermediate level code, which is indicated by the waveform (D) in FIG. 6.

Figure 6:
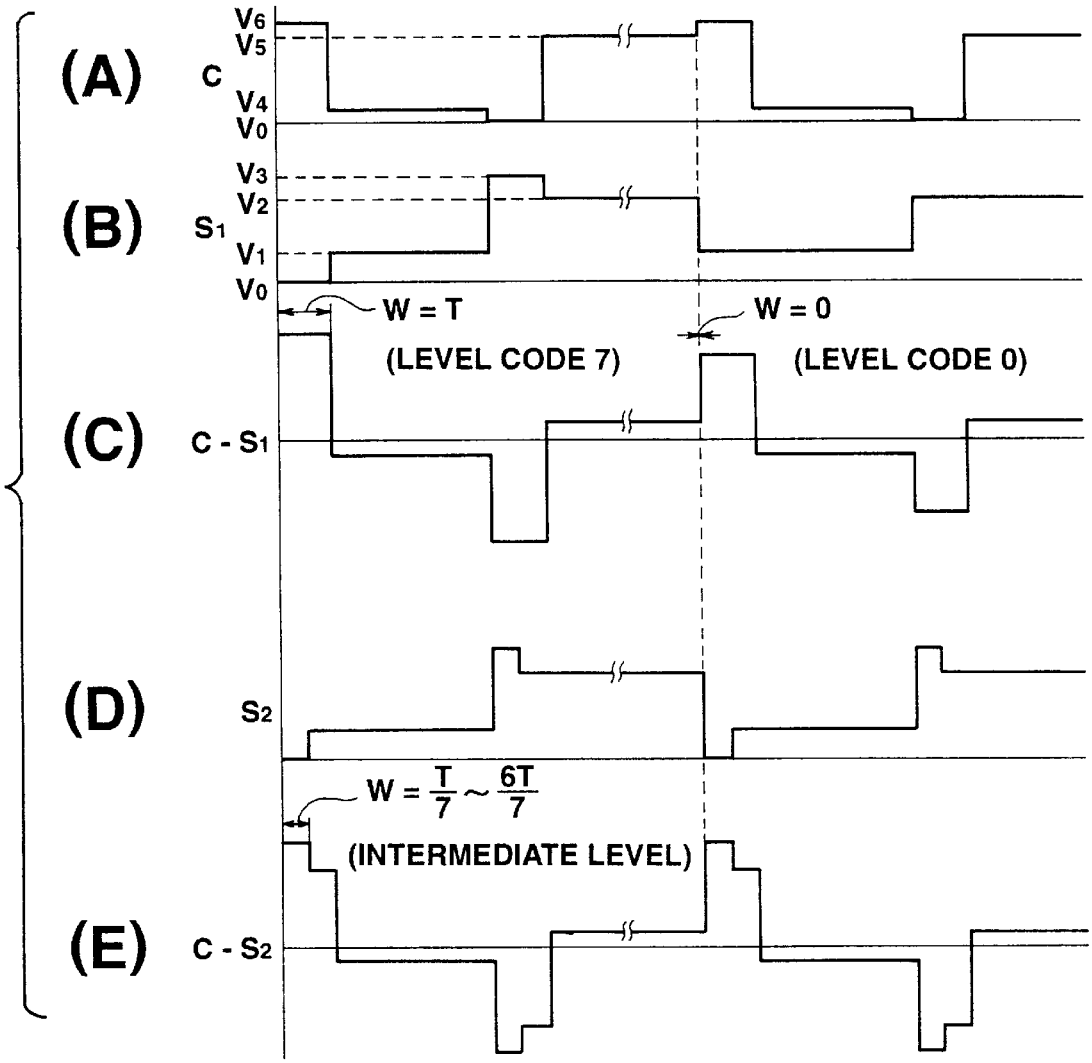
FIG. 6 is a timing chart showing waveforms (A)–(E) of signal voltages for driving the liquid crystal display element in FIG. 1 and the waveform of a scanning voltage therefor.

Meanwhile, a scanning voltage having the waveform (A) in FIG. 6 is applied to the scanning elements 15, and an effective voltage consisting of a driving voltage indicated by the waveform (C) or (E) in FIG. 6 is applied to each of the portions opposing the scanning and signal electrodes 15 and 16, i.e., each of the pixel portions of the liquid crystal layer 20, thereby displaying the color defined by the image data at each pixel.

When the detected temperature is, for example, 50° C., since the detected temperature is more than 40° C., the conversion circuit 34 uses the conversion table for 40° C. or more to convert the image data into a corresponding voltage designation signal on the conversion table. According to the conversion table for 40° C. or more, image data for defining "white" is converted into a voltage designation signal of level code "0", and all the image data for defining "red", "blue", "green", and the like are converted into voltage designation signals of level code "7". The conversion circuit 34 then outputs such a voltage designation signal.

The column drivers 36A and 36B modulate the signal voltage in accordance with the supplied voltage designation signal and apply the modulated signal voltage to the signal electrodes 16. For example, upon reception of a voltage designation signal of level code "0", each driver outputs a signal voltage of W=0, which is indicated by the waveform (B) in FIG. 6 and corresponds to level code "0", to the signal electrodes 16. Upon reception of a voltage designation signal of level code "7", each driver outputs a signal voltage of W=T. which is indicated by the waveform (B) in FIG. 6 and corresponds to level code "7".

In this case, therefore, the display color is either "white" or "green". That is, an image having eight colors defined by the image data is converted into an image having two colors with a "white" background portion and a "green" display portion. Although the colorfulness of the image deteriorates to some degree, a two-color image with high perceptibility which allows clear distinction is displayed.

As described above, according to this embodiment, even if the temperature in the operation environment rises, and the temperature of the liquid crystal layer itself rises, a clear image can be displayed.

In the above embodiment, 40° C. is selected as the temperature at which a multicolor display operation is switched to a two-color display operation. However, an arbitrary temperature can be selected as this temperature. For example, 35° C. or 50° C. may be selected.

In the above embodiment, in the normal temperature range in which the detected temperature is below 40° C., a constant effective voltage is applied to the liquid crystal layer 20 with respect to the same image data even with a change in detected temperature. However, for example, the conversion table shown in FIG. 7 may be used. In this case, in the temperature range in which the detected temperature is below 50° C., the effective voltage applied to the liquid crystal layer 20 may be lowered in units of level codes in predetermined temperature increment steps so as to compensate for a change in display color with a rise in temperature.

More specifically, according to the conversion table in FIG. 7, image data for defining "white" is always converted into a voltage designation signal of level code "0" regardless of the temperature. On the other hand, image data for defining "red" is converted into a voltage designation signal of level code "5" when the detected temperature is 30° C. or less; a voltage designation signal of level code "4" when the detected temperature is 30° C. or more and less than 40° C.; and a voltage designation signal of level code "3" when the detected temperature is 40° C. or more and less than 50° C. With this operation, a change in display color with a rise in temperature in the normal temperature range (below 50° C. in this case) is compensated, and hence colors almost identical to the colors defined by the image data are displayed. In the high temperature range in which the detected temperature is an abnormally high temperature of 50° C. or more, all image data for defining intermediate colors including "red" are converted into voltage designation signals of level code "7". As a result, "green" which is different from the colors defined by the image data is displayed. This is because when "green" is displayed, the aligned state of the liquid crystal molecules is a forced aligned state in which the liquid crystal molecules are almost raised upon application of the effective voltage based on the voltage designation signal of level code "7", i.e., the highest effective voltage, and this state is not influenced by other conditions such as temperature.

As described above, at normal temperatures in a predetermined temperature range, colors defined by image data are properly displayed upon temperature compensation. At abnormally high temperatures exceeding the predetermined temperature range, a two-color display is forcibly performed by using the highest and lowest effective voltages to provide a clear display. Note that even the aligned state of the liquid crystal molecules on the transparent substrate on which the lowest effective voltage corresponding to the voltage designation signal of level code "0" changes with a rise in temperature. However, the influence of this change in aligned state on the display color is not large as compared with the case of the intermediate levels (level codes 2 to 6). That is, white becomes slightly reddish. In this case, almost no deterioration in the perceptibility of the display occurs.

In the above embodiment, *"white" and "green" are selected as the display colors at high temperatures. This is because the difference between the effective voltages for displaying "white" and "green" is large, and "green" can be stably displayed regardless of changes in temperature. However, the display colors are not limited to these colors, and arbitrary colors may be selected in accordance with the characteristics of the color liquid crystal display element 11 and the like.

The number of display colors at high temperatures is not limited to two, but three or more colors may be used. For example, when the detected temperature exceeds a predetermined value, image data may be converted into the following three voltage designation signals in the corresponding temperature range: a signal for "red (level code 3)", a signal for "blue (level code 4)", and a signal for "green (level code 7)". In this case, a display operation can be performed by using the three primary colors, i.e., "red", "blue", and "green", and a color image can be displayed without any deterioration in perceptibility.

In addition, the display colors at normal temperatures are not limited to the eight colors. That is, the present invention can be applied a color liquid crystal display device which always obtains a clear color display by properly selecting one of at least the following two groups: a group consisting of n effective voltages and a group consisting of m (different from n) effective voltages, and applying effective voltages corresponding to image data in the selected group to the liquid crystal layer.

Figure 9:
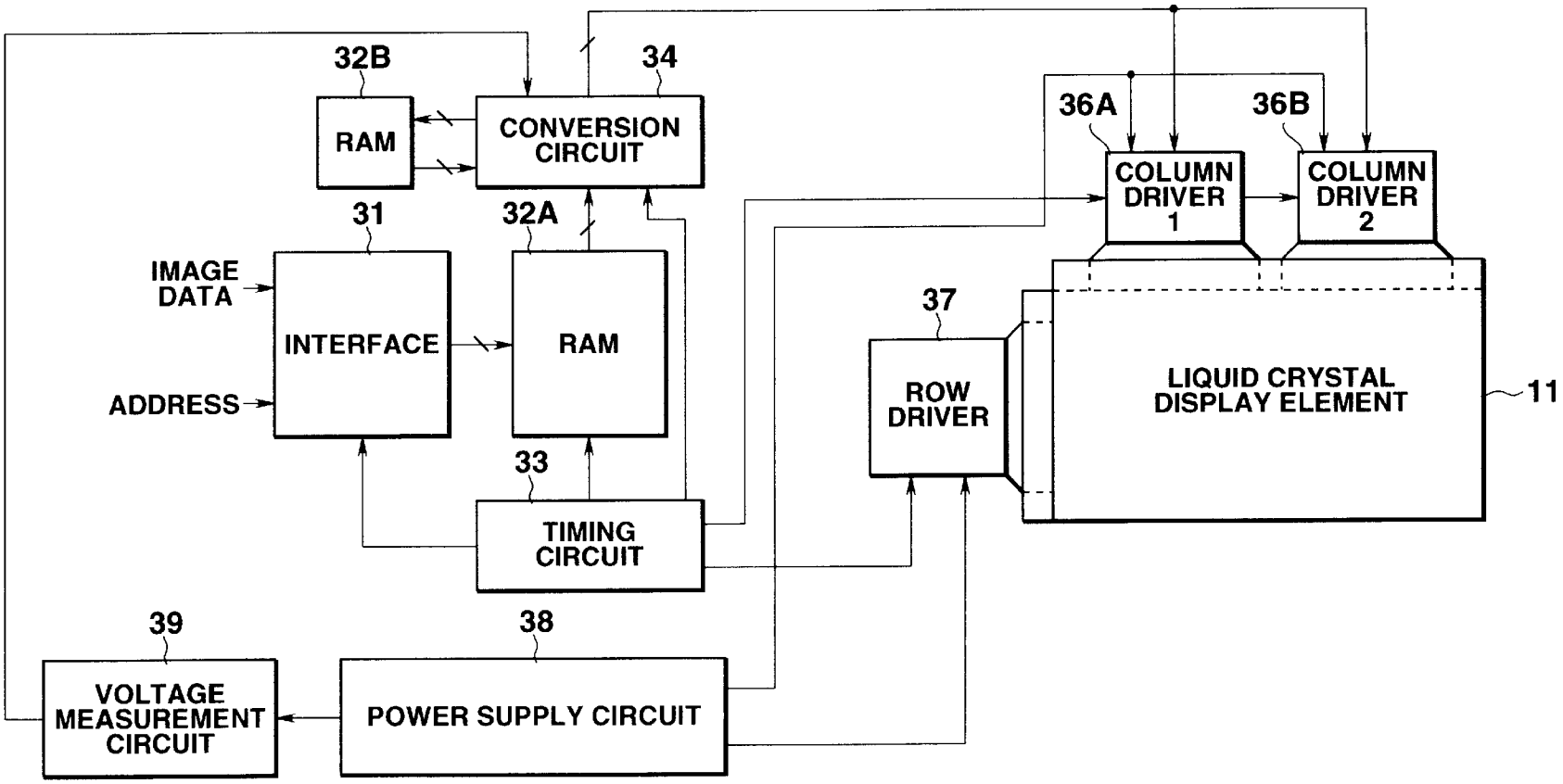
FIG. 9 is a block diagram showing a liquid crystal display element according to another embodiment of the present invention and its drive control circuit.

Another embodiment of the present invention will be described next with reference to FIG. 9.

In this embodiment, instead of detecting the temperature of a liquid crystal display element 11, the power supply voltage of a power supply circuit 38 is measured by a voltage measurement circuit 39. This measurement signal is output to a conversion circuit 34. A conversion table in which voltage designation signals corresponding to image data are determined in each of predetermined power supply voltage ranges is stored in a RAM 32B. In this case, similar to the conversion tables shown in FIGS. 5 and 7, the numbers of different voltage designation signals, i.e., the numbers of different effective voltages, set in the respective voltage ranges are different from each other. The conversion circuit 34 reads out voltage designation signals from the RAM 32B in accordance with a measurement signal obtained by measuring the power supply voltage and image data from a RAM 32A, and outputs the signals to column drivers 36A and 36B. Other arrangements are the same as those in the above embodiment described above with reference to FIG. 4.

With this operation, a color display with excellent perceptibility can be obtained regardless of variations in power supply voltage. In this case, when the power supply voltage varies, effective voltages applied in correspondence with the same voltage designation signal differ. If, however, voltage designation signals are set in consideration of effective voltage offsets in the respective power supply voltage ranges, a desired color display can be obtained.

In this embodiment as well, if the temperature of the liquid crystal display element is detected, and the groups of effective voltages to be applied are switched in accordance with this detected temperature, a color image with good perceptibility can always be obtained even if both the temperature of the liquid crystal display element and the power supply voltage vary.

The present invention is not limited to the two embodiments described above, and other various embodiments are included in the range of the present invention.

In the above case, groups of effective voltages are switched in accordance with conditions which influence the behavior of the liquid crystal molecules, e.g., the temperature of the liquid crystal element, the power supply voltage, and the like. In addition, however, groups of effective voltages to be applied may be switched in accordance with the differences between colors defined by image data and the display colors may be detected by color sensors for detecting display colors to switch groups of effective voltages to be applied in accordance with the detected differences. In this case, the same combinations of image data and voltage designation signals are always set for pixels whose display colors are to be detected. If, for example, the conversion table in FIG. 5 is to be used, it suffices to give image data of "white" to a color detection pixel.

In each embodiment described above, image data is converted into a voltage designation signal by using the conversion table. However, image data read out from the RAM 32A may be converted into image data representing a color which can be displayed, and a signal voltage corresponding to the image data having undergone the conversion may be applied to the signal electrodes 16. As described above, a method of limiting the display colors can be arbitrarily selected.

Note that the waveforms (A) to (E) in FIG. 6 are examples, and the present invention is not limited to those.

In each embodiment described above, the present invention is applied to a PWN type color liquid crystal display device designed to adjust the pulse width W of a pulse signal voltage in accordance with a voltage designation signal. However, the present invention can also be applied to a PAM type color liquid crystal display device designed to adjust the pulse height of a pulse signal voltage in accordance with a voltage designation signal.

In each embodiment described above, the simple matrix liquid crystal display element is time-divisionally driven. However,. the present invention may be applied to, e.g., an active matrix liquid crystal display element using TFTs (thin-film transistors) or the like as active elements. In this case, the voltage applied to each pixel electrode via a data line and an active element is changed in accordance with image data and driving conditions such as temperature.

In each embodiment described above, the characteristics of the liquid crystal cell 12, e.g., the twist angle and the retardation, can be arbitrarily changed. For example, a liquid crystal cell having a twist angle of 100° to 140°, which is larger than that of a general TN liquid crystal cell, may be used. In this case, excellent color separation performance can be obtained, and the color purity of each display color can be improved as compared with a TN liquid crystal cell having a twist angle of about 90°.

The present invention is not limited to TN liquid crystal display elements and may be applied to a liquid crystal display element of a type which controls the birefringence of light transmitted through the element by controlling the applied voltage, thereby changing the display color. For example, the present invention can be applied to a liquid crystal display device using a liquid crystal cell of a vertical molecule alignment type, a horizontal molecule alignment type, or a hybrid molecule alignment type as the liquid crystal cell 12.

In each embodiment described above, the reflection type liquid crystal display element 11 having the reflecting plate 24 is used. However, the present invention can also be applied to a transmission type liquid crystal display element.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color liquid crystal display device comprising:

a liquid crystal display element for controlling a birefringence action of a liquid crystal layer sandwiched between a pair of substrates by applying a voltage to the liquid crystal layer, thereby displaying a plurality of colors;

image data supply means for supplying image data for defining colors to be displayed; and drive control means for selecting one of a plurality of groups including a first group constituted by n (a positive integer) different effective voltages preset for the image data, and a second group constituted by m (a positive integer different from n) different effective voltages preset for the image data, and applying the effective voltages in the selected group which are related to the image data to the liquid crystal layer.

2. A device according to claim 1, wherein said drive control means comprises means for selecting a group of effective voltages to be applied in accordance with a condition which influences a behavior of liquid crystal molecules of said liquid crystal display element, selecting effective voltages corresponding to the image data from the selected group of effective voltages, and applying the effective voltages to the liquid crystal layer.

3. A device according to claim 1, wherein said drive control means comprises detection means for detecting a change in the condition which influences the behavior of the liquid crystal molecules of said liquid crystal display element and outputting a correction signal, and means for receiving the correction signal, selecting a group of effective voltages to be applied in accordance with the correction signal, selecting effective voltages corresponding to the image data from the selected group of effective voltages, and applying the effective voltages to the liquid crystal layer.

4. A device according to claim 1, wherein said drive control means comprises detection means for detecting a change in the condition which influences the behavior of the liquid crystal molecules of said liquid crystal display element and outputting a correction signal, voltage generating means for generating n different signal voltages to be applied to one of groups of electrodes respectively formed on opposing surfaces of the substrates of said liquid crystal display element, and means for selecting the group of effective voltages in accordance with the correction signal from said detection means, selecting signal voltages, from the n signal voltages, which provide at least one effective voltage, in the selected group of effective voltages, which correspond to the image data, and applying the selected signal voltages to said electrodes.

5. A device according to claim 1, wherein said drive control means comprises detection means for outputting a detection signal by detecting a temperature of said liquid crystal display element, and selecting means for selecting a group of effective voltages to be applied in accordance with a correction signal from said detection means, selecting at least one effective voltage corresponding to the image data from the selected group, and applying the effective voltages to the liquid crystal layer.

6. A device according to claim 5, wherein said selecting means comprises storage means for storing effective voltages to be applied to the liquid crystal layer in accordance with the image data for each of a plurality of temperature ranges of said liquid crystal display element, and voltage applying means for reading out effective voltages from said storage means on the basis of the image data and the detection signal, and applying the effective voltages to the liquid crystal layer.

7. A device according to claim 5, wherein said selecting means comprises voltage generating means for generating pulse signal voltages to be applied to one of groups of electrodes formed on opposing surfaces of the substrates of said liquid crystal display element, storage means for storing voltage designation signals for designating effective voltages to be applied to the liquid crystal layer of said liquid crystal display element for each of a plurality of temperature ranges of said liquid crystal display element in correspondence with the image data, and voltage modulation applying means for reading out the voltage designation signals from said storage means in accordance with the image data and the detection signal, modulating the pulse voltages in accordance with the readout voltage designation signals, and applying the modulated voltages to said electrodes.

8. A device according to claim 7, wherein said voltage modulation applying means comprises pulse width modulation type voltage modulation applying means for changing pulse widths of the pulse voltages in accordance with the voltage designation signals.

9. A device according to claim 7, wherein said voltage modulation applying means comprises pulse height modulation type voltage modulation applying means for changing pulse heights of the pulse voltages in accordance with the voltage designation signals.

10. A device according to claim 7, wherein said storage means stores n voltage designation signals for designating n effective voltages in a range not exceeding a predetermined temperature, and one of two voltage designation signals for designating lowest and highest voltages of the n effective voltages in a range exceeding the predetermined temperature in correspondence with the image data.

11. A device according to claim 1, wherein said drive control means comprises detection means for detecting a voltage of a power supply for generating a voltage to be applied to said liquid crystal display element, and means for selecting a group of effective voltages to be applied in accordance with a detection signal from said detection means, selecting at least one effective voltage corresponding to the image data from the selected group of effective voltages, and applying the effective voltages to the liquid crystal layer.

12. A device according to claim 1, wherein said liquid crystal display element comprises a liquid crystal cell having the liquid crystal layer set in an aligned state to twist liquid crystal molecules between the substrates, a pair of polarizing plates arranged to sandwich the liquid crystal cell, a retardation plate arranged between one of the polarizing plates and the liquid crystal cell, and a reflecting plate for reflecting light emerging from the polarizing plate on a rear surface side opposite to a display surface to cause the light to be incident on the polarizing plate on the rear surface side.

13. A device according to claim 12, wherein a twist angle of liquid crystal molecules of the liquid crystal cell is an angle within a range of 230° to 270°, a value of a product $\Delta n \cdot d$ of a refractive index anisotropy $\Delta n$ of a liquid crystal and a liquid crystal layer thickness d is a value within a range of 1,300 nm to 1,500 nm, and a value of a retardation of the retardation plate is a value within a range of 1,450 nm to 1,750 nm.

14. A color liquid crystal display device comprising:

a liquid crystal display element for controlling a birefringence action of a liquid crystal layer by applying voltages to the liquid crystal layer sandwiched between a pair of substrates, thereby displaying a color image constituted by a plurality of display colors;

image data supply means for supplying image data for designating a color, of n colors, which is to be displayed; and drive control means for driving said liquid crystal display element such that at least two types of images expressed by different combinations of colors, one type of image being expressed by a combination of n colors, and the other type of image being expressed by a combination of m colors smaller in number than n colors, are switched in accordance with a condition which influences a behavior of liquid crystal molecules.

15. A device according to claim 14, wherein said drive control means comprises detection means for detecting a temperature of said liquid crystal display element and outputting a detection signal, and means for switching the combinations of the colors of images in accordance with the detection signal from said detection means.

16. A device according to claim 14, wherein said drive control means comprises detection means for detecting a voltage of a power supply for generating a voltage to be applied to said liquid crystal display element and outputting a detection signal, and means for switching the combinations of the colors of images in accordance with the detection signal from said detection means.

17. A method of driving a color liquid crystal display device, comprising:

a step of controlling a birefringence action of a liquid crystal layer sandwiched between a pair of substrates by applying voltages corresponding to image data to the liquid crystal layer, thereby displaying a plurality of colors;

a step of supplying the image data for defining colors to be displayed;

a step of defining a first group of n (a positive integer) effective voltages preset for the image data;

a step of defining a group, other than the first group, which is constituted by m (a positive integer different from n) different effective voltages preset for the image data; and a voltage application step of selecting one of the first group and the group other than the first group, and applying effective voltages, of the effective voltages of the selected group, which are preset for the image data to the liquid crystal layer.

18. A method according to claim 17, wherein the voltage application step comprises a sub-step of outputting a correction signal in accordance with a condition which influences a behavior of liquid crystal molecules of said liquid crystal display element, and a sub-step of selecting a group of effective voltages to be applied to the liquid crystal in accordance with the correction signal, and applying effective voltages, of the selected group of effective voltages, which correspond to the image data to the liquid crystal layer.

19. A method according to claim 17, wherein each of the steps of defining the groups of effective voltages includes a sub-step of storing effective voltages to be applied to the liquid crystal layer for each temperature range of said liquid crystal display element in accordance with the image data, and the voltage application step comprises a sub-step of detecting a temperature of said liquid crystal display element and outputting a detection signal, a sub-step of reading out effective voltages from said storage means in accordance with the image data and the detection signal, and a sub-step of applying the readout effective voltages to the liquid crystal layer.

20. A method according to claim 17, wherein each of the steps of defining the groups of effective voltages includes a sub-step of storing voltage designation signals for designating effective voltages to be applied to the liquid crystal layer for each of a plurality of temperature ranges of said liquid crystal display element in correspondence with the image data, and the voltage application step comprises a sub-step of generating pulse signal voltages to be applied to one of groups of electrodes formed on opposing surfaces of the substrates of said liquid crystal display element, a sub-step of detecting a temperature of said liquid crystal display element and outputting a detection signal, a sub-step of reading out the voltage designation signals from said storage means in accordance with the detection signal and the image data, and a sub-step of modulating the pulse signal voltages in accordance with the readout voltage designation signals and applying the modulated voltages to the liquid crystal layer.

21. A method according to claim 20, wherein the sub-step of storing the voltage designation signals is a sub-step of storing, in said storage means, n voltage designation signals for designating n effective voltages in a range not exceeding a predetermined temperature of said liquid crystal display element, and one of two voltage designation signals for designating lowest and highest voltages of the n effective voltages in a range exceeding the predetermined temperature in correspondence with the image data.

* * * * *